US010173827B1

(12) United States Patent
Foote, Jr.

(10) Patent No.: US 10,173,827 B1
(45) Date of Patent: Jan. 8, 2019

(54) BEVERAGE CONTAINER INSULATOR ASSEMBLIES AND INSULATOR SLEEVES

(71) Applicant: Jeff Foote, Jr., Monroe, LA (US)

(72) Inventor: Jeff Foote, Jr., Monroe, LA (US)

( * ) Notice: Subject to any disclaimer, the term of this patent is extended or adjusted under 35 U.S.C. 154(b) by 33 days.

(21) Appl. No.: 15/358,675

(22) Filed: Nov. 22, 2016

Related U.S. Application Data

(60) Provisional application No. 62/258,800, filed on Nov. 23, 2015.

(51) Int. Cl.

| | |
|---|---|
| ***B65D 81/38*** | (2006.01) |
| ***B65D 23/08*** | (2006.01) |
| ***A47G 23/02*** | (2006.01) |
| *A47G 23/04* | (2006.01) |

(52) U.S. Cl.
CPC ..... *B65D 81/3876* (2013.01); *A47G 23/0241* (2013.01); *A47G 23/04* (2013.01); *A47G 2023/0275* (2013.01); *A47G 2023/0283* (2013.01); *A47G 2023/0291* (2013.01); *B65D 81/3888* (2013.01)

(58) Field of Classification Search
CPC .... A47G 2023/0291; A47G 2023/0275; A47G 2023/0283; A47G 23/0241; A47G 23/04; A47G 23/0225; B65D 81/3876; B65D 81/3888; B60N 3/10; F25D 2331/803; F25D 31/007
USPC ..... 220/739, 902, 903, 592.24, 626; 215/386, 395, 12.1; 62/457.3, 457.4, 62/457.8, 530, 372
See application file for complete search history.

(56) References Cited

U.S. PATENT DOCUMENTS

| | | | | | |
|---|---|---|---|---|---|
| 3,766,975 | A * | 10/1973 | Todd | A47G 19/2288 | 126/400 |
| 4,163,374 | A * | 8/1979 | Moore | B65D 81/3883 | 220/592.01 |
| 4,468,933 | A * | 9/1984 | Christopher | A45C 11/20 | 383/110 |
| 4,771,911 | A * | 9/1988 | Morony | B65D 11/16 | 215/12.1 |
| 5,704,484 | A * | 1/1998 | Spinks | B65D 23/0885 | 206/521 |
| D392,095 | S * | 3/1998 | Myers | D3/229 | |
| 5,915,580 | A * | 6/1999 | Melk | B65D 23/08 | 215/386 |

(Continued)

*Primary Examiner* — J. Gregory Pickett
*Assistant Examiner* — Gideon Weinerth
(74) *Attorney, Agent, or Firm* — R. Keith Harrison

(57) ABSTRACT

Beverage container insulator assemblies include a beverage insulator having a beverage insulator interior. A retaining collar is carried by the beverage insulator and has a collar opening. A beverage container is in the beverage insulator interior of the beverage insulator. The beverage container extends through the collar opening of the retaining collar. An insulator sleeve includes a sleeve base encircling the beverage container and retained between the beverage insulator and the retaining collar. A thermally-insulating, flexible, expandable and contractible insulator sleeve body extends from the sleeve base through the collar opening of the retaining collar. The insulator sleeve body engages and substantially conforms to the beverage container. An expandable sleeve neck on the insulator sleeve body engages the beverage container. Insulator sleeves for beverage containers are also disclosed.

20 Claims, 9 Drawing Sheets

(56) References Cited

U.S. PATENT DOCUMENTS

| | | | | |
|---|---|---|---|---|
| D476,856 | S * | 7/2003 | Belton | D7/605 |
| 6,799,693 | B2 | 10/2004 | Meza | |
| 6,814,252 | B2 | 11/2004 | Murakami et al. | |
| 7,201,285 | B2 | 4/2007 | Beggins | |
| 7,614,516 | B2 | 11/2009 | Beggins | |
| D685,615 | S * | 7/2013 | Altieri | D7/608 |
| 9,022,252 | B2 | 5/2015 | Beggins et al. | |
| 2009/0095765 | A1* | 4/2009 | Guard | A47G 23/0225 220/739 |
| 2010/0095948 | A1* | 4/2010 | Christy | A47J 36/2411 126/263.01 |
| 2010/0139310 | A1* | 6/2010 | Poterek | F25D 3/08 62/457.4 |
| 2011/0056969 | A1* | 3/2011 | Crain | B65D 81/3876 220/739 |
| 2015/0096995 | A1* | 4/2015 | Cunningham | B65D 81/3876 220/739 |
| 2016/0046430 | A1* | 2/2016 | Tractenberg | B65D 81/3876 220/739 |
| 2017/0157481 | A1* | 6/2017 | Sessa | A63B 60/62 |

* cited by examiner

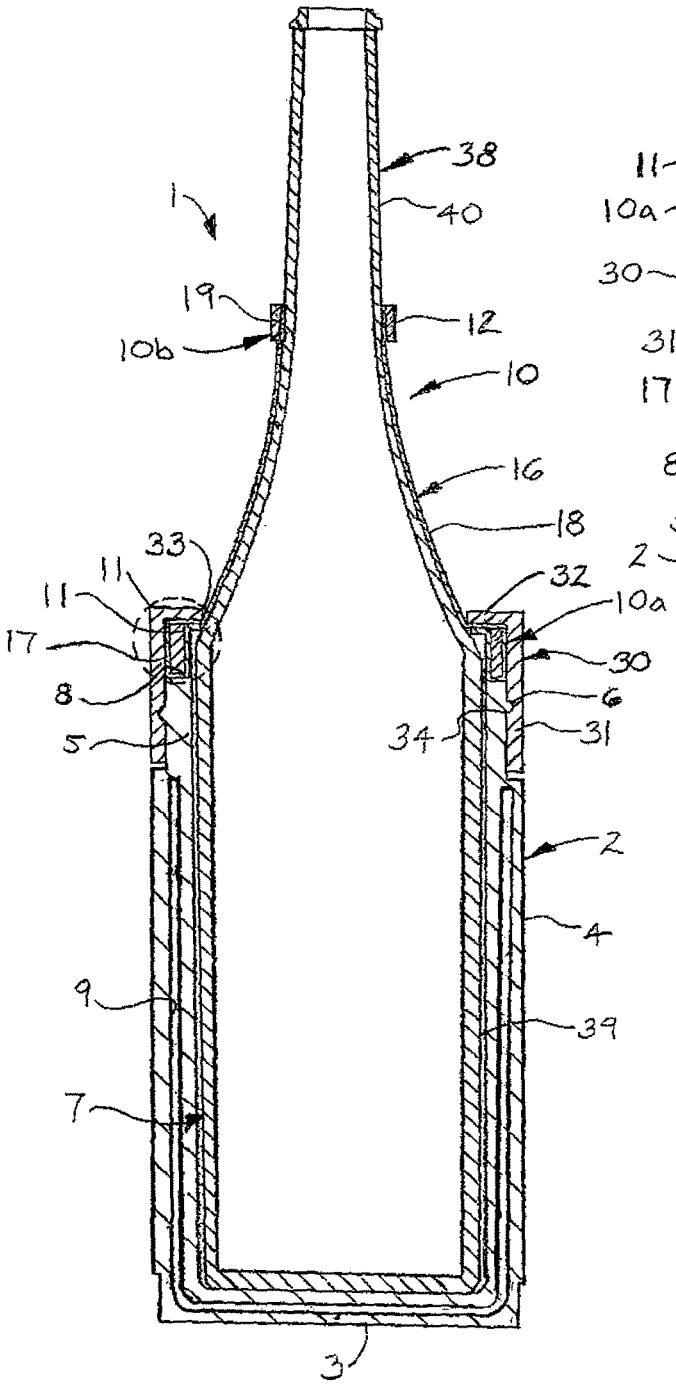
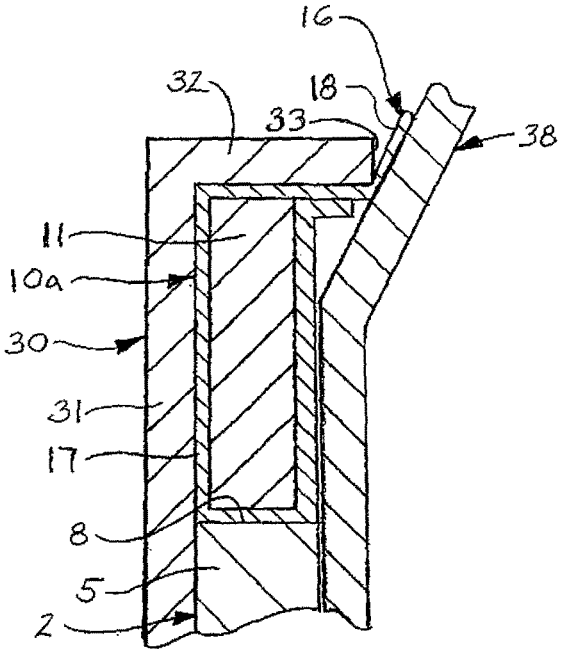
FIG. 11
FIG. 10

BEVERAGE CONTAINER INSULATOR ASSEMBLIES AND INSULATOR SLEEVES

CROSS-REFERENCE TO RELATED APPLICATIONS

This application claims the benefit of U.S. provisional application No. 62/258,800, filed Nov. 23, 2015 and entitled BEVERAGE CONTAINER INSULATOR ASSEMBLIES AND INSULATOR SLEEVES, which provisional application is hereby incorporated by reference herein in its entirety.

FIELD

Illustrative embodiments of the disclosure generally relate to beverage containers. More particularly, illustrative embodiments of the disclosure relate to beverage container insulator assemblies and insulator sleeves which insulate and maintain a beverage container such as a beverage-containing bottle in a cold condition as the beverage is consumed.

SUMMARY

Illustrative embodiments of the disclosure are generally directed to beverage container insulator assemblies which insulate and maintain a beverage container such as a beverage-containing bottle in a cold condition as the beverage is consumed. An illustrative embodiment of the beverage container insulator assemblies includes a beverage insulator having a beverage insulator interior. A retaining collar is carried by the beverage insulator and has a collar opening. A beverage container is in the beverage insulator interior of the beverage insulator. The beverage container extends through the collar opening of the retaining collar. An insulator sleeve includes a sleeve base encircling the beverage container and retained between the beverage insulator and the retaining collar. A thermally-insulating, flexible, expandable and contractible insulator sleeve body extends from the sleeve base through the collar opening of the retaining collar. The insulator sleeve body engages and substantially conforms to the beverage container. An expandable sleeve neck on the insulator sleeve body engages the beverage container.

Illustrative embodiments of the disclosure are further generally directed to insulator sleeves for a beverage container. An illustrative embodiment of the insulator sleeves includes a sleeve base having an insulator sleeve base ring and a sleeve neck having an expandable insulator sleeve neck ring. A thermally-insulating, flexible and expandable insulator sleeve body includes an insulator sleeve body base portion carried by the insulator sleeve base ring of the sleeve base, an insulator sleeve body wall portion extending from the insulator sleeve body base portion and an insulator sleeve body neck portion at the sleeve neck. The insulator sleeve neck ring is carried by the insulator sleeve body neck portion.

BRIEF DESCRIPTION OF THE DRAWINGS

Illustrative embodiments of the disclosure will now be described, by way of example, with reference to the accompanying drawings, in which:

FIG. 10 is a longitudinal sectional view of the illustrative beverage container insulator assembly and beverage container illustrated in FIG. 9;

FIG. 11 is an enlarged sectional view, taken along section line 11 in FIG. 10;

DETAILED DESCRIPTION

The following detailed description is merely typical in nature and is not intended to limit the described embodiments or the application and uses of the described embodiments. As used herein, the word "typical" or "illustrative" means "serving as an example, instance, or illustration." Any implementation described herein as "typical" or "illustrative" is not necessarily to be construed as preferred or advantageous over other implementations. All of the implementations described below are typical implementations provided to enable persons skilled in the art to practice the disclosure and are not intended to limit the scope of the appended claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 9:
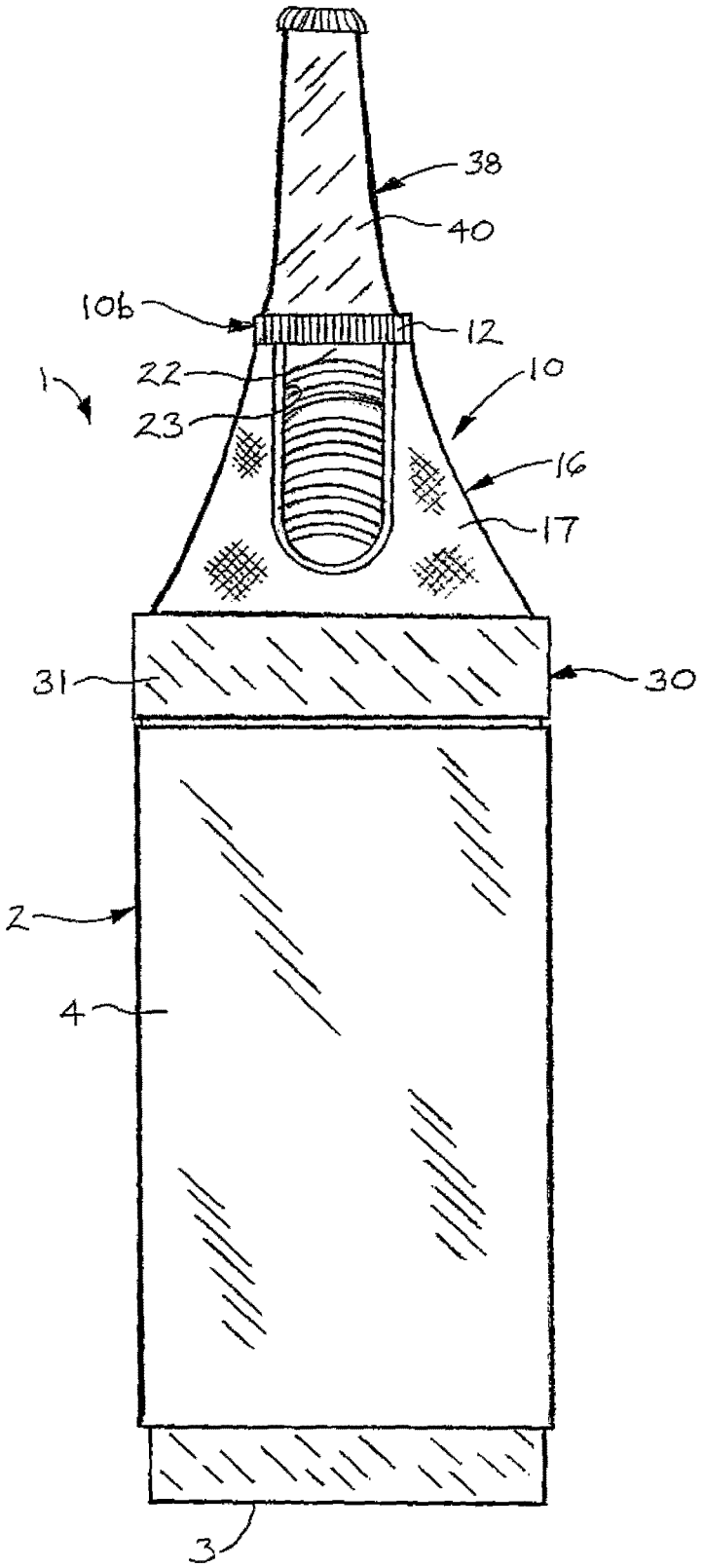
FIG. 9 is a front view of the illustrative assembled beverage container insulator assembly with a beverage container contained in the assembly in typical application of the assembly.
Figure 12:
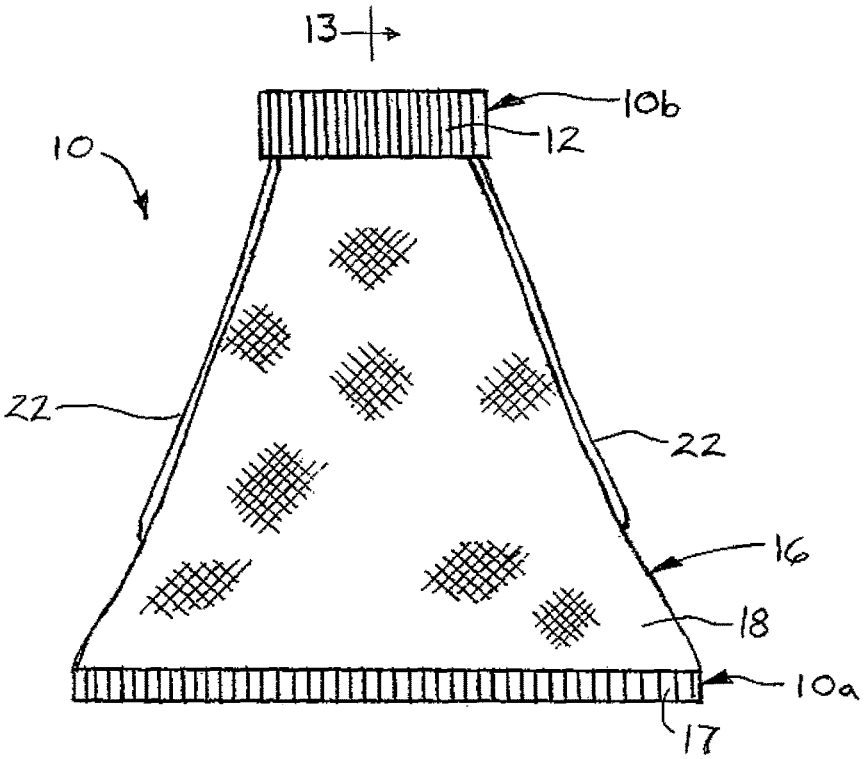
FIG. 12 is a side view of another typical insulator sleeve of the illustrative beverage container insulator assembly, which insulator sleeve has an annular insulator sleeve base ring.

Referring to the drawings, an illustrative embodiment of the beverage container insulator assemblies, hereinafter assembly, is generally indicated by reference numeral 1. As illustrated in FIGS. 9 and 10 and will be hereinafter described, the assembly 1 may include a beverage insulator 2. A retaining collar 30 may be provided on the beverage insulator 2. An insulator sleeve 10 may be retained between the beverage insulator 2 and the retaining collar 30, extending through the retaining collar 30. A beverage container 38, such as a bottle, which contains a beverage (not illustrated) is retained in and extends from the beverage container 2 through the insulator sleeve 10. Thus, the insulator sleeve 10 snugly engages at least a portion of the beverage container 38 which extends from the beverage container 2 to thermally insulate and maintain the beverage container 38 in a cold condition as the beverage in the beverage container 38 is consumed.

The beverage insulator 2 of the beverage container insulator assembly 1 may include a beverage insulator bottom 3. A beverage insulator wall 4, which may be generally elongated and cylindrical, may extend from the beverage insulator bottom 3. As illustrated in FIG. 10, an insulating space 9 may extend within the beverage insulator bottom 3 and the beverage insulator wall 4 of the beverage insulator 2. In some non-limiting embodiments, the insulating space 9 may be sealed by pulling a vacuum on the insulating space 9. In other embodiments, a thermally-insulating material (not illustrated) may fill the insulating space 9.

Figure 1:
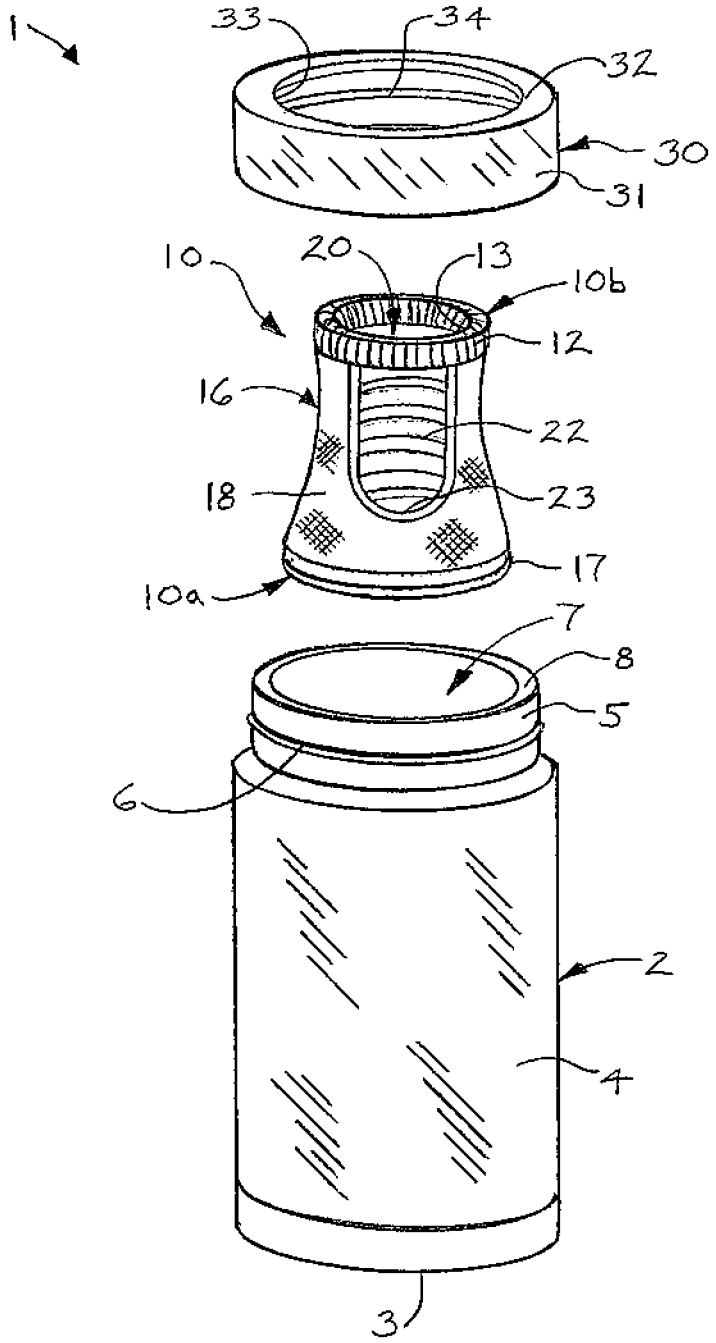
FIG. 1 is an exploded front perspective view of an illustrative embodiment of the beverage container insulator assemblies.
Figure 2:
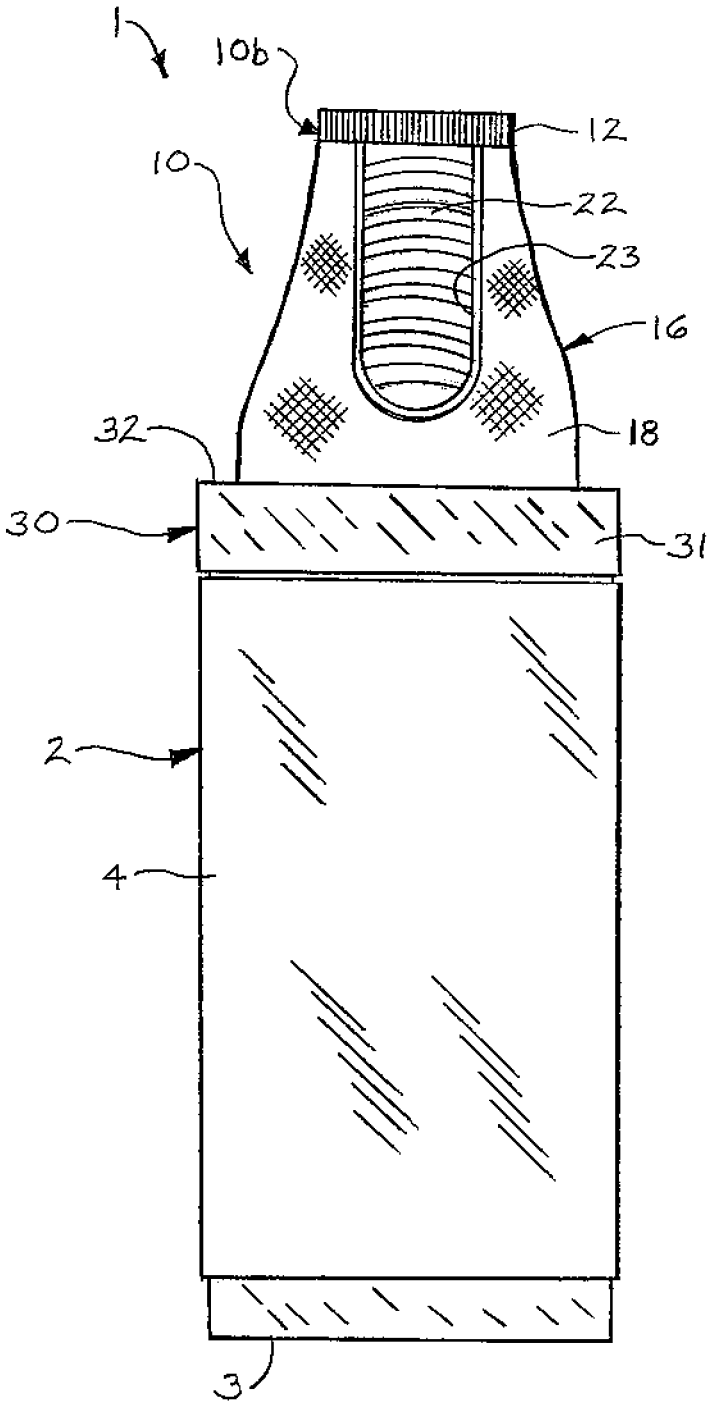
FIG. 2 is a front view of the illustrative assembled beverage container insulator assembly.
Figure 3:
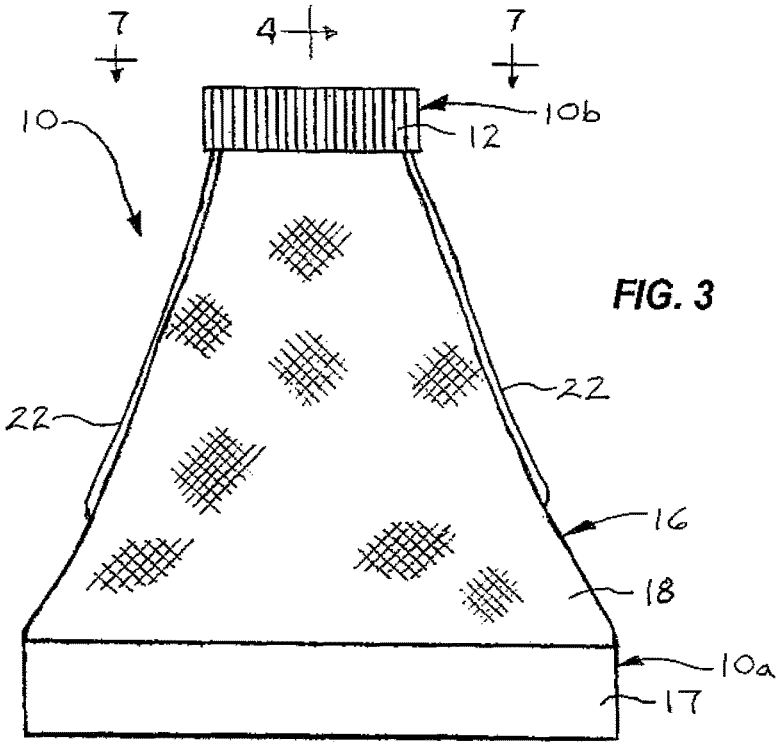
FIG. 3 is a side view of a typical insulator sleeve of the illustrative beverage container insulator assembly, which insulator sleeve has a generally cylindrical insulator sleeve base ring.

As illustrated in FIG. 1, a beverage insulator neck 5, terminating in a neck shoulder 8, may protrude from the beverage insulator wall 4. Exterior neck threads 6 may protrude from the beverage insulator neck 5. A beverage insulator interior 7 may be formed by and between the beverage insulator bottom 3, the beverage insulator wall 4 and the beverage insulator neck 5. Each of the beverage insulator bottom 3, the beverage insulator wall 4 and the beverage insulator neck 5 of the beverage insulator 2 may include metal such as aluminum or steel, for example and without limitation; plastic; a composite material; or any combination thereof.

The retaining collar 30 may include a cylindrical collar wall 31. A collar flange 32 having a collar opening 33 may protrude inwardly from the collar wall 31. Interior collar threads 34 may protrude from an interior surface of the collar wall 31. Accordingly, the retaining collar 30 may be attached to the beverage insulator 2 by threading the interior collar threads 34 in the collar wall 31 with the companion exterior neck threads 6 on the beverage insulator neck 5 of the beverage insulator 2. In some non-limiting embodiments, the beverage insulator 2 and the retaining collar 30 may be commercially-available as a YETI® beverage holder or colster.

Figure 4:
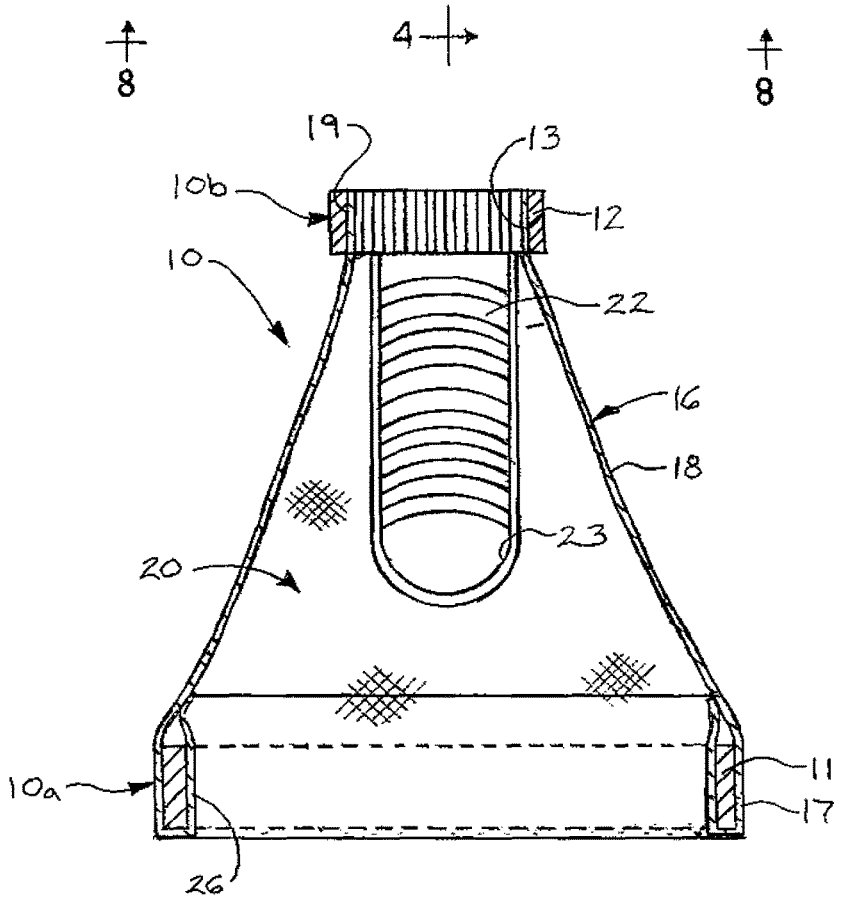
FIG. 4 is a sectional view, taken along section lines 4-4 in FIG. 3, of the illustrative insulator sleeve.
Figure 5:
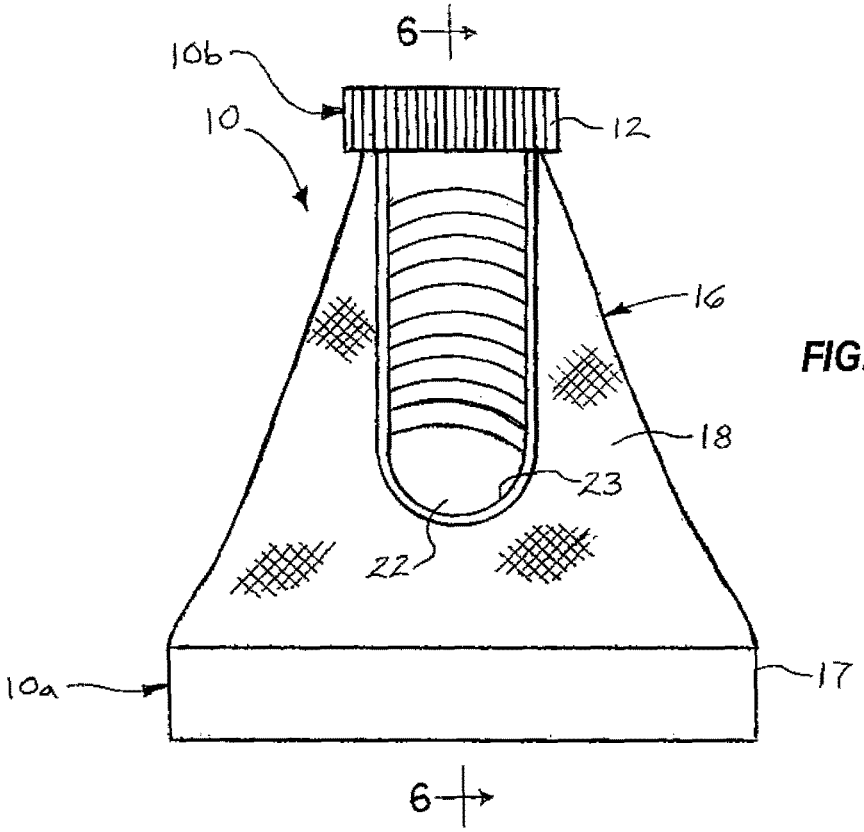
FIG. 5 is front view of the illustrative insulator sleeve.
Figure 6:
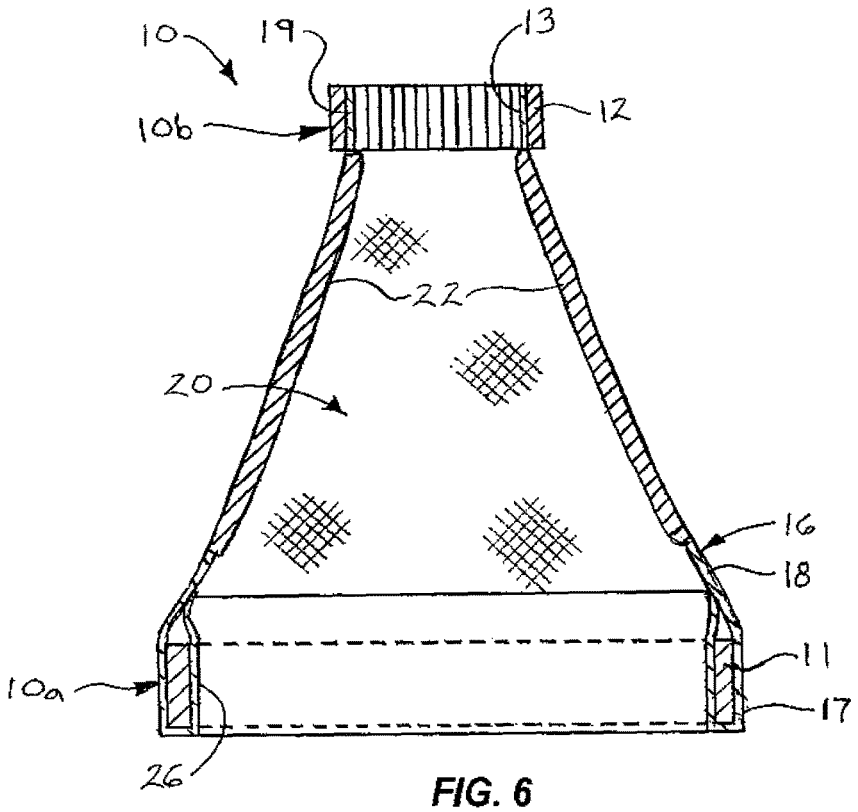
FIG. 6 is a sectional view, taken along section lines 6-6 in FIG. 5.
Figure 7:
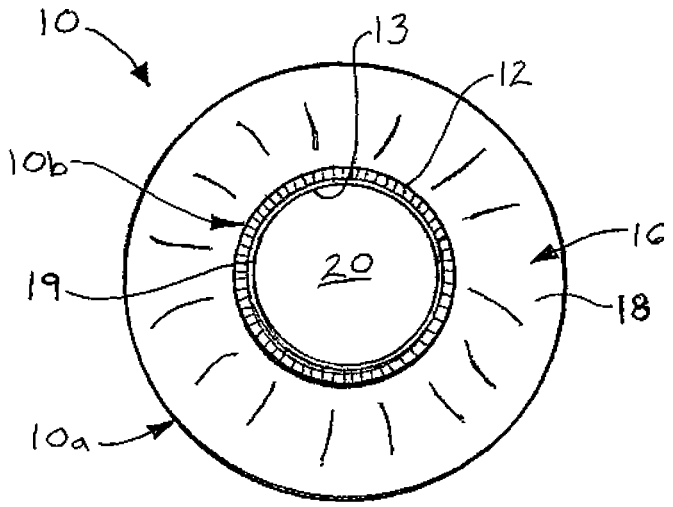
FIG. 7 is a top view of the illustrative insulator sleeve.
Figure 8:
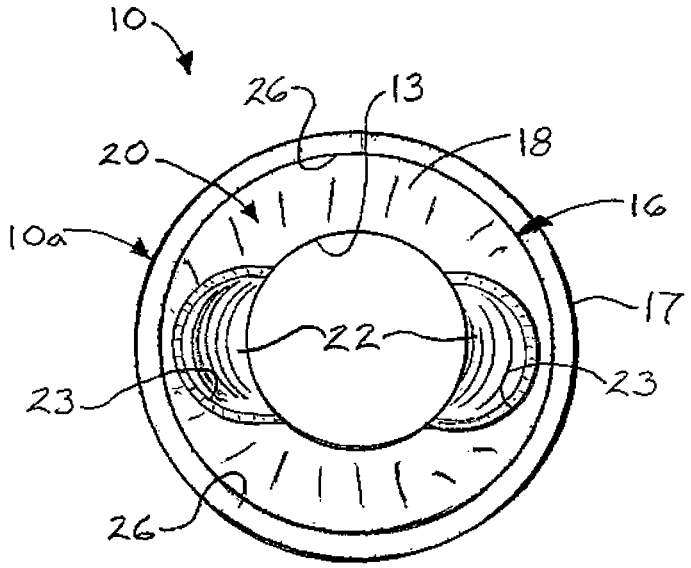
FIG. 8 is a bottom view of the illustrative insulator sleeve.
Figure 13:
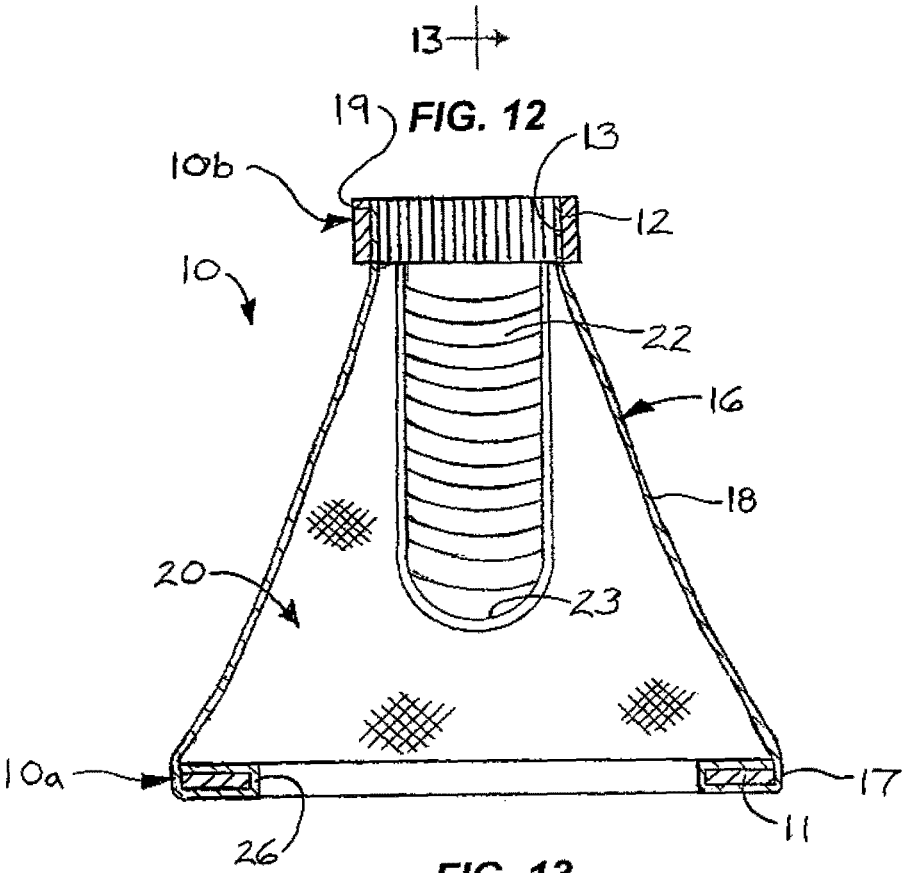
FIG. 13 is a sectional view, taken along section lines 13-13 in FIG. 12, of the illustrative insulator sleeve.
Figure 14:
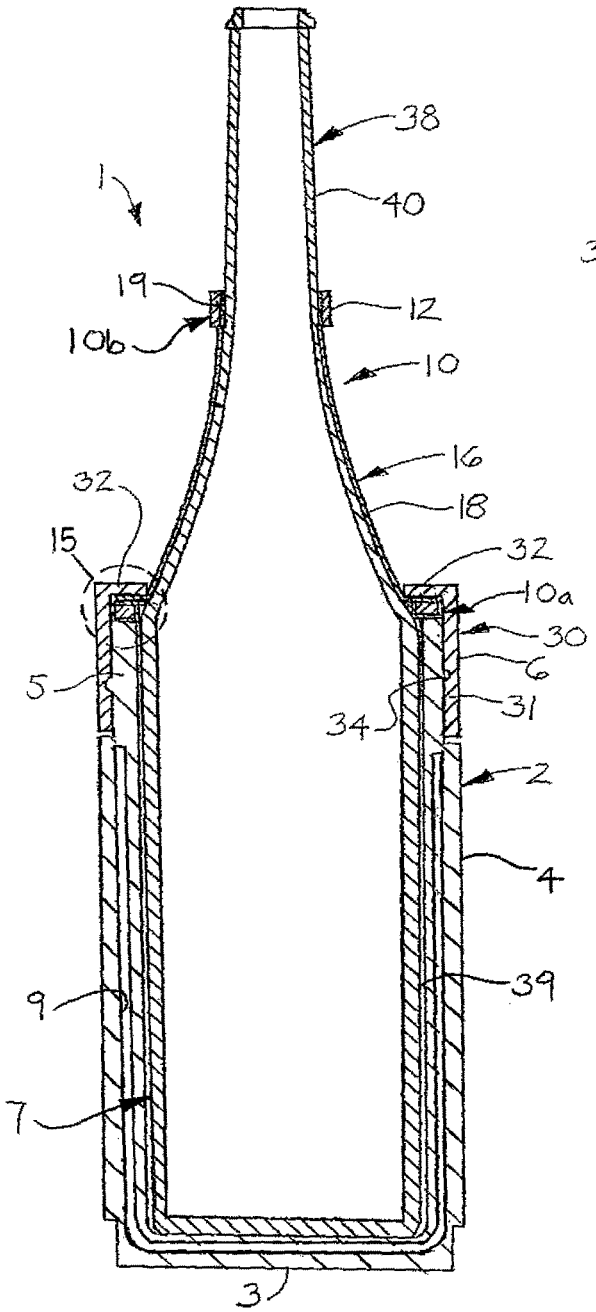
FIG. 14 is a longitudinal sectional view of an illustrative beverage container insulator assembly and beverage container having the insulator sleeve illustrated in FIGS. 12 and 13.
Figure 15:
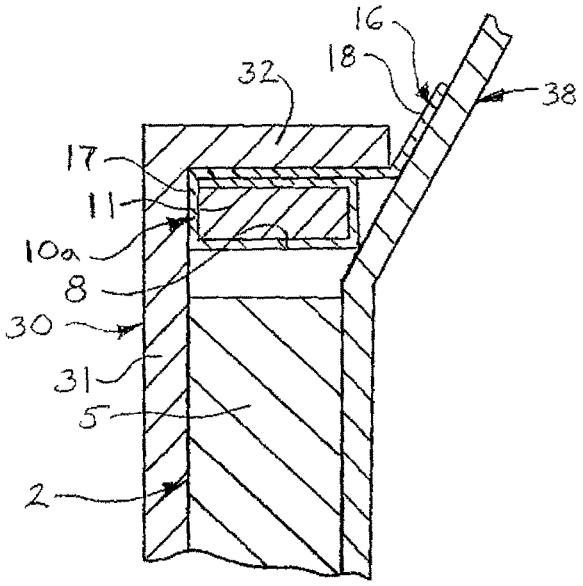
FIG. 15 is an enlarged sectional view, taken along section line 15 in FIG. 14.

The insulator sleeve 10 of the assembly 1 may have a sleeve base 10*a*, a sleeve neck 10*b* and a thermally-insulating and flexible, expandable and contractible insulator sleeve body 16 which extends between the sleeve base 10*a* and the sleeve neck 10*b*. As illustrated in FIGS. 4 and 6, the sleeve base 10*a* may include at least one generally rigid or semi-rigid and flexible insulator sleeve base ring 11. The insulator sleeve base ring 11 has a base ring opening 26 and may be metal, plastic, composite and/or other rigid, semi-rigid or flexible material which substantially holds its shape. The insulator sleeve base ring 11 may have a rectangular, circular or other cross-sectional shape. For example and without limitation, as illustrated in FIGS. 4 and 6, in some non-limiting embodiments, the insulator sleeve base ring 11 may have a generally cylindrical shape. As illustrated in FIG. 13, in other non-limiting embodiments, the insulator sleeve base ring 11 may have a generally flat ring shape.

The sleeve neck 10*b* of the insulator sleeve 10 may include at least one insulator sleeve neck ring 12. The insulator sleeve neck ring 12 has a neck ring opening 13 and may be formed of a ring of stretchable or elastic material such as rubber and/or stretchable fabric, for example and without limitation. The insulator sleeve neck ring 12 is capable of being stretched circumferentially outwardly and returning or recoiling to its original circumference or diameter when released. In its recoiled configuration, the insulator sleeve neck ring 12 may be smaller in diameter than the insulator sleeve base ring 11.

The insulator sleeve body 16 of the insulator sleeve 10 may have an insulator sleeve body base portion 17 which is attached to the insulator sleeve base ring 11 at the sleeve base 10*a* typically as will be hereinafter described. An insulator sleeve body wall portion 18 may extend from the insulator sleeve body base portion 17. The insulator sleeve body wall portion 18 may be generally frusta-conical in shape. An insulator sleeve body neck portion 19 may extend from the insulator sleeve body wall portion 18 of the insulator sleeve body 16. The insulator sleeve body neck portion 19 is attached to the insulator sleeve neck ring 12 at the sleeve neck 10*b* typically as will be hereinafter described. As further illustrated in FIGS. 4 and 6, the insulator sleeve wall portion 18 forms a sleeve interior 20 which communicates with the base ring opening 26 of the insulator sleeve base ring 11 and the neck ring opening 13 of the insulator sleeve neck ring 12.

The insulator sleeve base ring 11 of the sleeve base 10*a* may be attached to the insulator sleeve body base portion 17 of the insulator sleeve body 16 according to any suitable technique which is known by those skilled in the art. As illustrated in FIGS. 4 and 6, in some non-limiting embodiments, the insulator sleeve body base portion 17 may be looped around the insulator sleeve base ring 11 and stitched or otherwise attached to the insulator sleeve body wall portion 18. The insulator sleeve neck ring 12 of the sleeve neck 10*b* may be attached to the insulator sleeve body neck portion 19 of the insulator sleeve body 16 according to the knowledge of those skilled in the art. In some non-limiting embodiments, the interior surface of the insulator sleeve neck ring 12 may be sewn and/or otherwise attached to the exterior surface of the insulator sleeve body neck portion 19. In other embodiments, the insulator sleeve body neck portion 19 may be looped around the insulator sleeve neck ring 12 and stitched or otherwise attached to the insulator sleeve body wall portion 18, as was heretofore described with respect to attachment of the insulator sleeve base ring 11 to the insulator sleeve body base portion 17.

The insulator sleeve body 16 may be formed of a flexible insulating material which is capable of being stretched circumferentially and longitudinally between the insulator sleeve base ring 11 and the insulator sleeve neck ring 12. In some non-limiting embodiments, the insulator sleeve body 16 may be formed of a weaved fabric material having thermally-insulating properties. Non-limiting examples of materials which are suitable for the insulator sleeve body 16 include a polyester-polyurethane copolymer such as LYCRA (trademark) and foamed fabric materials known by those skilled in the art such as polyolefin elastomer foam, for example and without limitation.

At least one stretch panel 22 may be provided in the insulator sleeve body wall portion 18 of the insulator sleeve body 16. In some non-limiting embodiments, a pair of stretch panels 22 may be provided in the insulator sleeve body wall portion 18 in diametrically-opposed relationship to each other. The stretch panels 22 may extend longitudinally between the sleeve base 10*a* and the sleeve neck 10*b* of the insulator sleeve 10. Each stretch panel 22 may be sewn into a corresponding stretch panel notch 23 which is cut or otherwise provided in the insulator sleeve body wall portion 18. The stretch panels 22 may be stretchable in the circumferential dimension of the insulator sleeve body wall portion 18.

As illustrated in FIGS. 9 and 10, in typical application, the assembly 1 insulates and maintains a beverage container 38 in a cold condition as a beverage (not illustrated) in the beverage container 38 is consumed. As illustrated in FIG.

10, in some applications, the beverage container 38 may be a beverage-containing bottle having a beverage container base 39 and a beverage container neck 40 which extends from the beverage container base 39. Accordingly, the retaining collar 30 may initially be removed from the beverage insulator neck 5 of the beverage insulator 2 typically by unthreading the collar threads 34 (FIG. 1) in the retaining collar 30 from the companion neck threads 6 on the beverage container neck 5. The beverage container 38 may then be lowered into the beverage insulator interior 7 of the beverage insulator 2 with the beverage container base 39 resting on the beverage insulator bottom 3 of the beverage insulator 2 and the beverage container neck 40 extending from the beverage insulator interior 7.

Next, the insulator sleeve 10 may be slid down over the beverage container neck 40 of the beverage container 38. Accordingly, the sleeve base 10*a*, the insulator sleeve body 16 and the sleeve neck 10*b* are initially placed around the beverage container neck 40 and lowered in place until the sleeve base 10*a* rests on the neck shoulder 8 on the beverage insulator neck 5 of the beverage insulator 2. As it is lowered on the beverage container 38, the insulator sleeve body wall portion 18 of the insulator sleeve body 16 and the insulator sleeve neck ring 12 expand to accommodate and conform to the increasing diameter of the beverage container neck 40. Thus, the insulator sleeve body wall portion 18 of the insulator sleeve body 16 snugly engages the beverage container neck 40.

The retaining collar 30 may next be lowered in place over the beverage container neck 40 of the beverage container 38 and the insulator sleeve 10, respectively, onto the beverage insulator neck 5 of the beverage insulator 2. The retaining collar 30 may be attached to the beverage insulator neck 5 by rotating the retaining collar 30 to facilitate engagement of the collar threads 34 in the retaining collar 30 with the companion neck threads 6 on the beverage insulator neck 5. Accordingly, as illustrated in FIGS. 10 and 11, the collar wall 31 and the collar flange 32 of the retaining collar 30 retain the sleeve base 10*a* of the insulator sleeve 10 against the neck shoulder 8 on the beverage insulator neck 5. Thus, the beverage insulator 2 can be angled and inverted to expel the beverage from the beverage container base 39 through the beverage container neck 40 as the retaining collar 30 both retains the beverage container 38 in the beverage insulator 2 and the insulator sleeve 10 on the beverage container 38. The insulator sleeve 10 thermally insulates the beverage container neck 40 to help maintain the beverage (not illustrated) which is contained inside the beverage insulator 2 in a cold condition as the beverage is dispensed from the beverage container 38. After use, the empty beverage container 38 can be selectively removed from the beverage insulator 2 by unthreading the retaining collar 30 from the beverage insulator neck 5 of the beverage insulator 2, removing the insulator sleeve 10 from the beverage container 38 and removing the beverage container 38 from the beverage insulator interior 7 of the beverage insulator 2.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A beverage container insulator assembly, comprising:

a beverage insulator having a beverage insulator neck, a neck shoulder terminating the beverage insulator neck and a beverage insulator interior;

a retaining collar carried by the beverage insulator, the retaining collar having a collar wall, a collar flange extending from the collar wall and a collar opening formed by the collar flange;

a beverage container in the beverage insulator interior of the beverage insulator, the beverage container extending through the collar opening of the retaining collar;

an insulator sleeve including:

a sleeve base encircling the beverage container and retained between the neck shoulder of the beverage insulator and the collar wall and the collar flange of the retaining collar, the collar wall and the collar flange of the retaining collar retaining the sleeve base against the neck shoulder on the beverage insulator neck with the retaining collar retaining the beverage container in the beverage insulator and the insulator sleeve on the beverage container;

a thermally-insulating, flexible, expandable and contractible insulator sleeve body extending from the sleeve base through the collar opening of the retaining collar, the insulator sleeve body engaging and substantially conforming to the beverage container; and an expandable sleeve neck on the insulator sleeve body, the sleeve neck engaging the beverage container.

2. The beverage container insulator assembly of claim 1 wherein the insulator sleeve comprises an insulator sleeve body base portion and an insulator sleeve base ring carried by the insulator sleeve body base portion at the sleeve base, an insulator sleeve body wall portion extending from the insulator sleeve body base portion, an insulator sleeve body neck portion extending from the insulator sleeve body wall portion and an insulator sleeve neck ring carried by the insulator sleeve body neck portion at the sleeve neck.

3. The beverage container insulator assembly of claim 2 further comprising at least one stretch panel in the insulator sleeve body wall portion of the insulator sleeve.

4. The beverage container insulator assembly of claim 2 wherein the insulator sleeve base ring has a generally cylindrical shape.

5. The beverage container insulator assembly of claim 2 wherein the insulator sleeve base ring has a generally flat ring shape.

6. The beverage container insulator assembly of claim 1 wherein the insulator sleeve base ring is metal, plastic, or composite.

7. The beverage container insulator assembly of claim 2 wherein the insulator sleeve neck ring is a ring of stretchable or elastic material.

8. The beverage container insulator assembly of claim 2 wherein the insulator sleeve body wall portion of the insulator sleeve body is generally frusto-conical in shape.

9. A beverage container insulator assembly, comprising:

a beverage insulator having a beverage insulator wall, a beverage insulator interior formed by the beverage insulator wall, a beverage insulator neck in the beverage insulator wall and a neck shoulder on the beverage insulator neck;

a retaining collar carried by the beverage insulator, the retaining collar having a collar wall, a collar flange extending from the collar wall and a collar opening in the collar flange;

a beverage container in the beverage insulator interior of the beverage insulator, the beverage container extending through the collar opening of the retaining collar; and an insulator sleeve including:

a sleeve base encircling the beverage container and retained between the neck shoulder on the beverage insulator and the collar wall and the collar flange on the retaining collar, the collar wall and the collar flange of the retaining collar retaining the sleeve base against the neck shoulder on the beverage insulator neck with the retaining collar retaining the beverage container in the beverage insulator and the insulator sleeve on the beverage container;

a thermally-insulating, flexible, expandable and contractible insulator sleeve body extending from the sleeve base through the collar opening of the retaining collar, the insulator sleeve body engaging and substantially conforming to the beverage container; and an expandable sleeve neck on the insulator sleeve body, the sleeve neck engaging the beverage container.

10. The beverage container insulator of claim 9 wherein the insulator sleeve comprises an insulator sleeve body base portion and an insulator sleeve base ring carried by the insulator sleeve body base portion at the sleeve base, an insulator sleeve body wall portion extending from the insulator sleeve body base portion, an insulator sleeve body neck portion extending from the insulator sleeve body wall portion and an insulator sleeve neck ring carried by the insulator sleeve body neck portion at the sleeve neck.

11. The beverage container insulator assembly of claim 10 further comprising at least one stretch panel in the insulator sleeve body wall portion of the insulator sleeve.

12. The beverage container insulator assembly of claim 10 wherein the insulator sleeve base ring has a generally cylindrical shape.

13. The beverage container insulator assembly of claim 10 wherein the insulator sleeve base ring has a generally flat ring shape.

14. The beverage container insulator assembly of claim 10 wherein the insulator sleeve base ring is metal, plastic, or composite.

15. The beverage container insulator assembly of claim 10 wherein the insulator sleeve neck ring is a ring of stretchable or elastic material.

16. The beverage container insulator assembly of claim 10 wherein the insulator sleeve body wall portion of the insulator sleeve body is generally frusta-conical in shape.

17. An insulator sleeve for a beverage container, comprising:

a sleeve base having an insulator sleeve base ring;

a sleeve neck having an expandable insulator sleeve neck ring;

a thermally-insulating, flexible and expandable insulator sleeve body including:

an insulator sleeve body base portion carried by the insulator sleeve base ring of the sleeve base;

an insulator sleeve body wall portion extending from the insulator sleeve body base portion, the insulator sleeve body base portion looped around the insulator sleeve base ring of the sleeve base and attached to the insulator sleeve body wall portion; and an insulator sleeve body neck portion at the sleeve neck, the insulator sleeve neck ring carried by the insulator sleeve body neck portion.

18. The insulator sleeve of claim 17 wherein the insulator sleeve neck ring is a ring of stretchable or elastic material.

19. The beverage container insulator assembly of claim 17 wherein the insulator sleeve body wall portion of the insulator sleeve body is generally frusto-conical in shape.

20. The beverage container insulator assembly of claim 17 further comprising at least one stretch panel in the insulator sleeve body wall portion of the insulator sleeve.

* * * * *